US010240859B2

(12) United States Patent
Cizik et al.

(10) Patent No.: US 10,240,859 B2
(45) Date of Patent: Mar. 26, 2019

(54) DOMESTIC REFRIGERATION APPLIANCE APPARATUS AND METHOD OF OPERATING THE APPARATUS

(71) Applicant: BSH HAUSGERAETE GMBH, Munich (DE)

(72) Inventors: Herbert Cizik, Ottenbach (DE); Stefan Deissler, Noerdlingen (DE); Andrea Fink, Gerstetten (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/686,197

(22) Filed: Aug. 25, 2017

(65) Prior Publication Data

US 2018/0058751 A1 Mar. 1, 2018

(30) Foreign Application Priority Data

Aug. 30, 2016 (DE) ..... 10 2016 216 302

(51) Int. Cl.
*F25D 25/02* (2006.01)
*F25D 23/08* (2006.01)
*F25D 25/00* (2006.01)

(52) U.S. Cl.
CPC ..... *F25D 25/025* (2013.01); *F25D 23/08* (2013.01); *F25D 25/021* (2013.01); *F25D 25/005* (2013.01)

(58) Field of Classification Search
CPC .... F25D 25/005; F25D 25/021; F25D 25/025; F25D 23/08
USPC ..... 312/401, 402, 404, 408, 330.1
See application file for complete search history.

(56) References Cited

U.S. PATENT DOCUMENTS

2004/0031705 A1* 2/2004 DeTemple, II ..... A47J 47/10 206/213.1
2007/0262686 A1* 11/2007 Ji ..... A47B 88/00 312/402
2008/0265733 A1* 10/2008 Hue ..... F25D 25/025 312/404
2009/0199587 A1 8/2009 Matthews et al.
2012/0146477 A1* 6/2012 Bischofberger ..... F25D 25/025 312/404
2016/0341469 A1* 11/2016 Hanson ..... F25D 25/025
2016/0356538 A1* 12/2016 Park ..... F25D 25/025

FOREIGN PATENT DOCUMENTS

DE 112006000823 T5 2/2008

* cited by examiner

*Primary Examiner* — James O Hansen
(74) *Attorney, Agent, or Firm* — Laurence A. Greenberg; Werner H. Stemer; Ralph E. Locher

(57) ABSTRACT

A domestic refrigeration appliance apparatus has an appliance body, which partially defines a refrigeration chamber, and at least one storage unit which is arranged within the refrigeration chamber and which defines at least one storage chamber for storing food. The storage chamber is open in the direction of an upper face of the storage unit. A closing unit at least substantially closes the storage unit in the direction of the upper face in at least one storage state. In order to provide a generic apparatus with improved properties in respect of ease of operation, the domestic refrigeration appliance apparatus has one suspension unit, which supports the closing unit such it is able to oscillate relative to the appliance carcass in at least one operating state.

10 Claims, 2 Drawing Sheets

DOMESTIC REFRIGERATION APPLIANCE APPARATUS AND METHOD OF OPERATING THE APPARATUS

CROSS-REFERENCE TO RELATED APPLICATION

This application claims the priority, under 35 U.S.C. § 119, of German application DE 10 2016 216 302.7, filed Aug. 30, 2016; the prior application is herewith incorporated by reference in its entirety.

BACKGROUND OF THE INVENTION

Field of the Invention

The invention relates to a domestic refrigeration appliance apparatus and to a method for operating a domestic refrigeration appliance apparatus.

Already known from German utility model DE 11 2006 000 823 T5 corresponds to US 2009/0199587A1 is a domestic refrigeration appliance apparatus, which has an appliance carcass or body, which defines a refrigeration chamber. In an installed position a storage unit within the refrigeration chamber is arranged below a compartment base. The storage unit defines a storage chamber for storing food, which is open in the direction of an upper face of the storage unit. In a storage state a closing unit closes the storage unit in the direction of the upper face. In an installed position most of the closing unit is arranged below a compartment base. A suspension unit, part of which is configured as a single piece with the compartment base, supports the closing unit in such a manner that it can move vertically in and relative to the appliance body.

SUMMARY OF THE INVENTION

The object of the invention is in particular to provide a generic apparatus with improved properties in respect of ease of operation.

The invention is based on a domestic refrigeration appliance apparatus with at least one appliance body, which at least partially defines at least one refrigeration chamber, with at least one storage unit, which is arranged within the refrigeration chamber and which defines at least one storage chamber for storing food, which is open in the direction of an upper face of the storage unit. The domestic refrigeration appliance apparatus further having a closing unit, which at least substantially closes the storage unit in the direction of the upper face in at least one storage state.

It is proposed that the domestic refrigeration appliance apparatus has at least one suspension unit, which is configured, in particular separately from the closing unit and which supports the closing unit in such a manner that it is able to oscillate relative to the appliance carcass in at least one operating state.

A "domestic refrigeration appliance apparatus" refers in particular to at least a part, in particular a subassembly, of a domestic refrigeration appliance. The domestic refrigeration appliance is particularly advantageously provided to chill chilled goods, in particular food such as for example beverages, meat, fish, milk and/or dairy products, in particular to keep the chilled goods for longer, in at least one operating state. The domestic refrigeration appliance can be in particular a refrigerator and advantageously a refrigeration and/or freezer cabinet.

An "appliance carcass or body" refers in particular to a unit, which in at least one mounted state forms a part, in particular a large part, of an outer delimitation, in particular of a housing, advantageously of a domestic refrigeration appliance housing, and which in the mounted state defines a part, in particular a large part, of an outer delimitation at least of a refrigeration chamber, in particular of a chiller chamber and/or of a freezer chamber. In particular the domestic refrigeration appliance apparatus has at least one appliance door. An "appliance door" refers in particular to a unit, which in at least one mounted state is connected to the appliance body in such a manner that it can move and in particular be pivoted relative to the appliance carcass and which in particular in the mounted state forms a part of an outer delimitation, in particular of a housing, advantageously of a domestic refrigeration appliance housing. In at least one mounted state the appliance carcass and the appliance door together advantageously form the outer delimitation, in particular the housing, advantageously the domestic refrigeration appliance housing. In particular the appliance body has at least two side walls, at least one rear wall, preferably at least one upper face and at least one lower face, which together with the appliance door enclose the refrigeration chamber in at least one operating state In particular the storage unit forms at least one delimiting wall of the storage chamber. The storage unit in particular has an at least substantially trough-like configuration. The storage unit in particular forms at least one refrigeration compartment. For example the storage unit could form a chiller compartment and/or a vegetable compartment and/or a fruit compartment and/or a meat compartment and/or a keep-fresh compartment. An "upper face" of an object refers in particular to a face that faces away from a substrate in an installed position. The substrate could in particular be a base, in particular a floor and/or an installation surface, which could in particular be at least partially formed by the base.

In the storage state the closing unit and the storage unit define the storage chamber at least substantially and advantageously completely taking into account at least one sealing tolerance. The closing unit is configured in particular as a lid. For example the closing unit could be configured as a single part and/or as a single piece. Alternatively the closing unit could be configured as at least two parts, in particular as two parts and/or as multiple parts, it being possible in particular for individual parts, in particular elements and/or units of the closing unit, to be arranged at least substantially non-movably relative to one another. The closing unit is in particular free of openings and/or recesses, which are provided in particular to ventilate the storage chamber.

A "suspension unit" refers in particular to a unit, which in at least one operating state at least largely absorbs the force of the weight of the closing unit and/or passes it on to at least one further unit, for example the appliance carcass, and which supports the closing unit in particular in such a manner that it is able to oscillate relative to the appliance carcass. "At least largely" refers in particular to a proportion, in particular a proportion by mass and/or volume, of at least 70%, in particular at least 80%, advantageously at least 90% and preferably at least 95%. The suspension unit is in particular an independent unit and is configured in particular separately from further units of the domestic refrigeration appliance apparatus, in particular from the closing unit and/or from at least one compartment base. "Able to oscillate" refers in particular to being capable of vibration around at least one rest position in at least one state, in which only gravitational and friction forces act.

"Provided" means in particular specifically designed and/or equipped. That an object is provided for a specified function means in particular that an object satisfies and/or performs the specified function in at least one application and/or operating state.

The inventive embodiment allows in particular a high level of ease of operation to be achieved. In particular little force expenditure is required when moving the storage unit and/or closing unit, as when the storage unit is moved, the closing unit is held and/or supported in particular by the suspension unit and as when the closing unit is moved, the fact that the closing unit is supported in such a manner that it is able to oscillate means in particular that little force expenditure is required to move it. An alternative solution to the known prior art in particular can be provided.

It is further proposed that the suspension unit has at least one suspension element, which is fastened to two opposing sides of the appliance carcass. In particular the suspension unit has at least two, preferably identical, suspension elements. A "suspension element" refers in particular to an element of the suspension unit, from which the closing unit is suspended and by which it is supported in particular in such a manner that it is able to oscillate, in at least one mounted state. In at least one mounted state the suspension element in particular connects the opposing sides of the appliance carcass to one another. The opposing sides of the appliance carcass are in particular side walls of the appliance carcass. This allows a high level of stability in particular to be achieved, in particular in that the force of the weight of the closing unit is passed directly on to the appliance carcass.

It is also proposed that the suspension element has an at least substantially bar-type configuration. The suspension element in particular has a longitudinal extension, which is at least 5 times, in particular at least 10 times, advantageously at least 20 times, particularly advantageously at least 30 times and preferably at least 50 times as large as extensions of the suspension element aligned perpendicular to the longitudinal extension. A "longitudinal extension" of an object refers in particular to an extension of the object along a longitudinal extension direction of the object. A "longitudinal extension direction" of an object refers in particular to a direction, which is aligned parallel to a longest side of a smallest imaginary geometric square that still encloses the object completely. An "extension" of an object refers in particular to a maximum distance between two points of a perpendicular projection of the object onto a plane. When viewed in a cross-sectional plane perpendicular to a longitudinal extension of the suspension element, the suspension element could have for example an at least substantially angular, in particular rectangular and/or square and/or triangular configuration. When viewed in a cross-sectional plane perpendicular to a longitudinal extension of the suspension element, said suspension element advantageously has an at least substantially oval, in particular elliptical and/or circular configuration. The suspension element is preferably configured as tubular. This means in particular that little material is required for the suspension element, in particular compared with an at least substantially plate-like suspension element, thereby in particular allowing costs to be kept low.

The closing unit could for example be supported directly on the suspension element, for example by at least one single-piece continuation of the suspension element and/or closing unit. The suspension unit advantageously has at least one connecting element, which connects the suspension element and the closing unit to one another in such a manner that they can move relative to one another. In at least one mounted state the connecting element is in particular arranged at least partially between the suspension element and the closing unit and connects the suspension element and the closing unit to one another in particular in the mounted state. In particular the connecting element is fastened movably to the suspension element and/or to the closing unit, in order in particular to connect the suspension element and the closing unit to one another in such a manner that they can move relative to one another. This in particular allows a high level of flexibility to be achieved, in particular in respect of the ability of elements to move.

For example the connecting element and the closing unit could be connected to one another by a connection brought about by locking and/or by means of a connection brought about by clamping and/or by means of a rivet connection and/or by means of a screw connection in at least one mounted state. The connecting element and the closing unit are advantageously connected to one another with a force fit and/or form fit in at least one mounted state. For example the connecting element could have at least one latching recess, in which at least one latching element of the closing unit could engage in at least one mounted state. The connecting element preferably has at least one latching element, which is latched to the closing unit. In particular the closing unit has at least one latching recess, in which the latching element of the connecting element at least partially engages in at least one mounted state. During a fastening operation the latching element is deflected in particular elastically in order then to latch in the latching recess due to an internal tensioning force. In particular the latching element is arranged on an end region of the connecting element facing the closing unit in at least one mounted state. This in particular allows the closing unit to be mounted easily. In particular mounting and/or removal for the purpose of cleaning the closing unit and/or suspension unit can be achieved easily.

It is also proposed that the connecting element has at least one pivot bearing element, which is provided to support the closing unit. For example the pivot bearing element could be arranged on an end region of the connecting element facing the suspension element in at least one mounted state. In particular the pivot bearing element is arranged on an end region of the connecting element facing the closing unit in at least one mounted state. The pivot bearing element of the connecting element and the latching element of the connecting element are particularly advantageously configured as a single piece. "As a single piece" means in particular connected with a material fit, for example by means of a welding process and/or bonding process, etc., and particularly advantageously molded on, as when produced from one cast and/or when produced using a single component or multiple component injection method. This in particular allows easy movement of the closing unit. Oscillation of the closing element in the refrigeration appliance in particular is allowed.

It is further proposed that the connecting element has at least one hook element, which is suspended from the suspension element. In particular the hook element engages around the suspension element when viewed in at least one cross-sectional plane, which is aligned in particular perpendicular to a longitudinal extension of the suspension element, through an angular region of at least 90°, in particular at least 120°, advantageously at least 150° and preferably at least 180°, in relation to a geometric center point and/or center of gravity of the suspension element in the cross-sectional plane. This in particular allows easy mounting of the connecting element on the suspension element.

It is further proposed that the suspension unit has at least one positioning element, which at least partially determines a position of the connecting element on the suspension element. The positioning element determines the position of the connecting element on the suspension element in particular in relation to at least one longitudinal extension direction of the suspension element aligned at least substantially parallel to a longitudinal extension of the suspension element. The positioning element could also determine the position of the connecting element on the suspension element in particular in relation to at least one further longitudinal extension direction of the suspension element aligned antiparallel to the longitudinal extension direction. This allows in particular a high level of stability to be achieved. In particular the connecting element can be mounted easily on the suspension element, in particular further to removal of the connecting element from the suspension element by an operator. In particular the connecting element can be positioned precisely on the suspension element.

The positioning element could be configured for example as a single piece with the suspension element. For example the suspension element could have at least one stop and/or at least one projection and/or at least one raised element, which could form the positioning element and against which the connecting element could rest in at least one mounted state. Alternatively or additionally the suspension element could have at least one recess and/or at least one depression, which could form the positioning element and in which the connecting element could engage in at least one mounted state. The positioning element is preferably configured differently from the suspension element and at least partially encloses the suspension element. In particular the positioning element encloses the suspension element when viewed in at least one cross-sectional plane, which is aligned in particular perpendicular to a longitudinal extension of the suspension element, through an angular region of at least 180°, in particular at least 210°, advantageously at least 270°, preferably at least 300° and particularly preferably at least 350°, in relation to a geometric center point and/or center of gravity of the suspension element in the cross-sectional plane. When viewed in at least one cross-sectional plane, which is aligned in particular perpendicular to a longitudinal extension of the positioning element, the positioning element could have for example at least an at least substantially C-shaped configuration. Alternatively or additionally the positioning element could have for example an at least substantially annular configuration when viewed in at least one cross-sectional plane, which is aligned in particular perpendicular to a longitudinal extension of the positioning element. This in particular ensures a high level of ease of operation for an operator.

It is also proposed that the connecting element and/or the suspension element is/are made at least largely of plastic. In particular the connecting element and/or the suspension element is/are made at least largely of at least one thermoplastic plastic, such as for example polyoxymethylene (POM), and/or at least one synthetic terpolymer, such as for example the copolymer acrylonitrile butadiene styrene (ABS). "At least largely" refers in particular to a proportion of at least 70%, in particular at least 80%, advantageously at least 90% and preferably at least 95%. This in particular allows a good sliding action to be achieved, with the result in particular that noise resulting from movement can be avoided when the closing unit is moved relative to the appliance body.

It is also proposed that the domestic refrigeration appliance apparatus has at least one compartment base, below which the suspension unit, which is configured in particular separately from the compartment base, is arranged in an installed position. The compartment base is provided in particular to hold food positioned vertically and/or horizontally thereon. In particular the suspension unit is configured separately from the compartment base. In at least one mounted state the suspension unit is arranged at least substantially between the compartment base and the storage unit and/or the closing unit. The compartment base has in particular an at least substantially plate-like configuration. This in particular makes it easy for an operator to use and/or allows food to be positioned vertically thereon.

A particularly high level of ease of use can be achieved in particular by a domestic refrigeration appliance with at least one inventive domestic refrigeration appliance apparatus.

Ease of use can be further enhanced in particular by a method for operating an inventive domestic refrigeration appliance apparatus, with at least one appliance carcass, which at least partially defines at least one refrigeration chamber, with at least one storage unit, which is arranged within the refrigeration chamber and which defines at least one storage chamber for storing food, which is open in the direction of an upper face of the storage unit, and with a closing unit, which at least substantially closes the storage unit in the direction of the upper face in at least one storage state. It is proposed that the closing unit is supported in such a manner that it is able to oscillate relative to the appliance carcass in at least one operating state.

The domestic refrigeration appliance apparatus here is not limited to the application and embodiment described above. In particular the domestic refrigeration appliance apparatus can have a number of individual elements, components and units that is different from the number specified herein to satisfy a mode of operation described herein.

Further advantages will emerge from the description of the drawing which follows. The drawing shows exemplary embodiments of the invention. The drawing, description and claims contain numerous features in combination. The person skilled in the art will also expediently also consider the features individually and combine them in further useful combinations.

Other features which are considered as characteristic for the invention are set forth in the appended claims.

Although the invention is illustrated and described herein as embodied in a domestic refrigeration appliance apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
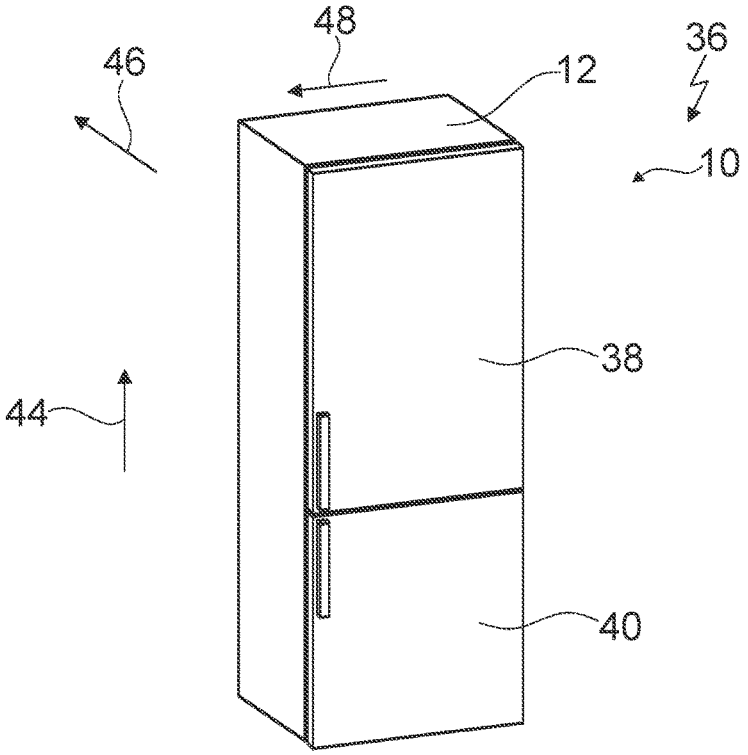
FIG. 1 is diagrammatic perspective view of a domestic refrigeration appliance with a domestic refrigeration appliance apparatus in a closed state.

Referring now to the figures of the drawings in detail and first, particularly to FIG. 1 thereof, there is shown a domestic refrigeration appliance 36 in a closed state. The domestic refrigeration appliance 36 is configured as a refrigerator and as a freezer, in particular as a combined refrigerator/freezer appliance. The domestic refrigeration appliance 36 has a domestic refrigeration appliance apparatus 10. The domestic refrigeration appliance apparatus 10 has an appliance carcass, frame or body 12.

Figure 2:
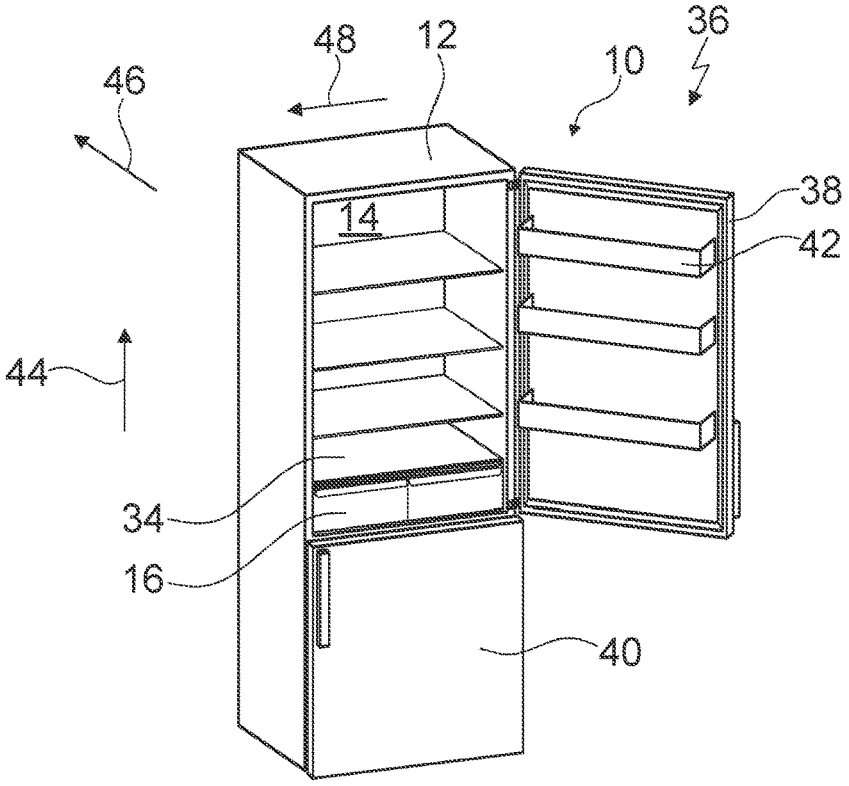
FIG. 2 is a perspective view of the domestic refrigeration appliance with the domestic refrigeration appliance apparatus in a partially open state.

The appliance body 12 partially defines a refrigeration chamber 14 (see FIG. 2). The refrigeration chamber 14 is configured as a chiller chamber. The domestic refrigeration appliance apparatus 10 has an appliance door 38. The appliance door 38 is supported in such a manner that it can be pivoted relative to the appliance body 12. In a closed state the appliance door 38 closes the refrigeration chamber 14.

The appliance body 12 partially defines a further non-illustrated refrigeration chamber. The further refrigeration chamber is configured as a freezer chamber. The domestic refrigeration appliance apparatus 10 has a further appliance door 40. The further appliance door 40 is supported in such a manner that it can be pivoted relative to the appliance body 12. In a closed state the further appliance door 40 closes the further refrigeration chamber. In an installed position the further refrigeration chamber is arranged below the refrigeration chamber 14.

The domestic refrigeration appliance apparatus 10 has at least one door tray 42 (see FIG. 2). Where multiple objects are present, only one is shown with a reference character in the figures. In the present exemplary embodiment the domestic refrigeration appliance apparatus 10 has three door trays 42. Only one of the door trays 42 is described in the following. The door tray 42 is fastened to the appliance door 38. In an operating state the door tray 42 is provided to hold food.

In the present exemplary embodiment the domestic refrigeration appliance apparatus 10 has four compartment bases 34 (see FIG. 2). The compartment bases 34 are arranged in a substantially equally distributed manner in a vertical direction 44 in the refrigeration chamber 14. The vertical direction 44 is aligned substantially perpendicular to a substrate, in particular to a base and/or floor. Only one of the compartment bases 34 is described in the following.

Figure 3:
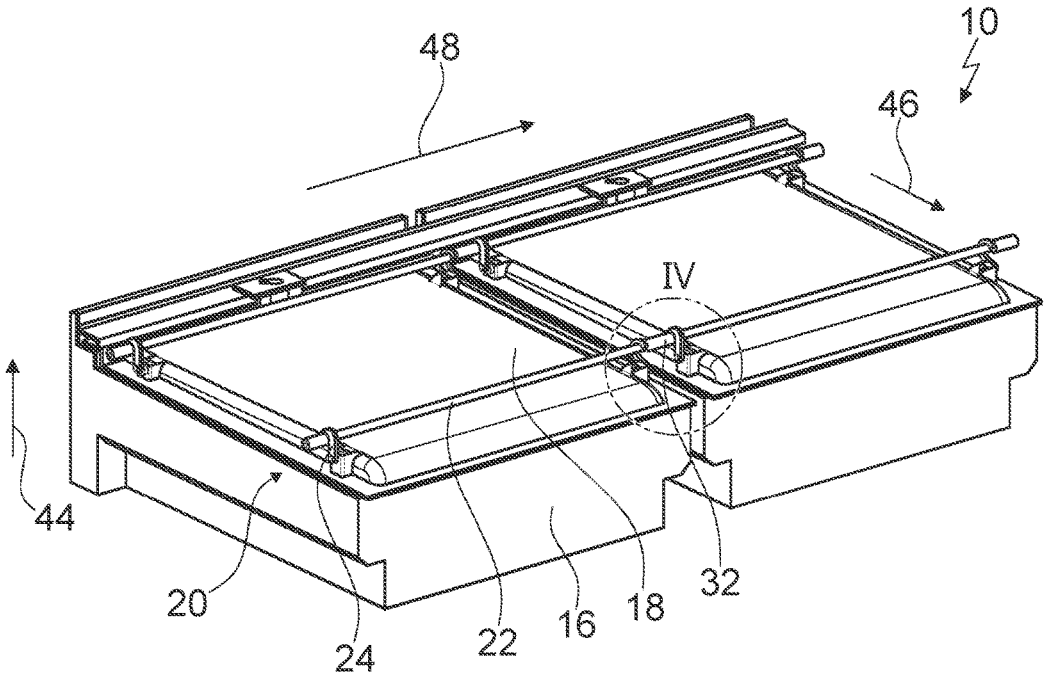
FIG. 3 is a perspective view of two storage units, two closing units and one suspension unit of the domestic refrigeration appliance apparatus.

In the present exemplary embodiment the domestic refrigeration appliance apparatus 10 has two storage units 16 (see FIGS. 2 and 3). The storage units 16 are arranged next to one another in a horizontal direction 48. The horizontal direction 48 is aligned substantially parallel to a substrate. The horizontal direction 48 is aligned substantially parallel to a rear wall of the appliance carcass 12. Only one of the storage units 16 is described in the following.

The storage unit 16 is arranged within the refrigeration chamber 14. In an installed position the storage unit 16 is arranged below the compartment base 34. The storage unit 16 defines a storage chamber for storing food, which is open in the direction of an upper face of the storage unit 16. The storage unit 16 is configured as a keep-fresh compartment. The storage unit 16 is configured as a pull-out compartment and/or as a drawer.

Figure 4:
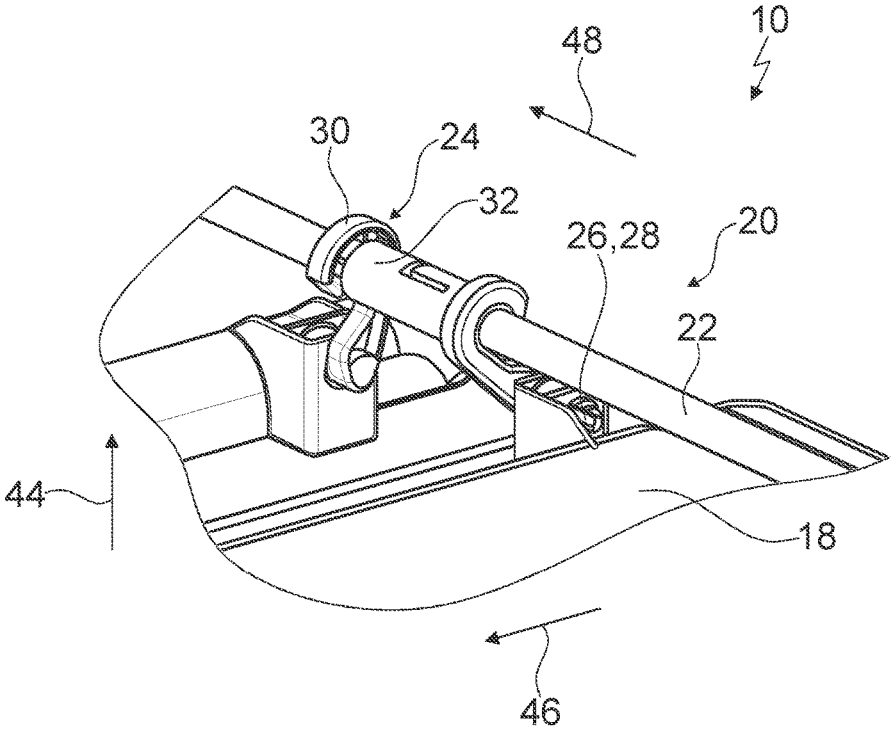
FIG. 4 is a perspective view of an enlarged detail from FIG. 3.

In the present exemplary embodiment the domestic refrigeration appliance apparatus 10 has two closing units 18 (see FIGS. 3 and 4). The number of storage units 16 and the number of closing units 18 are identical. One closing unit 18 is assigned to each storage unit 16 and provided for the storage unit 16. Only one of the closing units 18 is described in the following.

In an installed position the closing unit 18 is arranged above the storage unit 16. In a storage state the closing unit 18 substantially closes the storage unit 16 in the direction of the upper face. The closing unit 18 is configured as a lid of the storage unit 16.

In an installed position the closing unit 18 is arranged between the storage unit 16 and the compartment base 34. In a method for operating the domestic refrigeration appliance apparatus 10 the closing unit 18 is supported in such a manner that it is able to oscillate relative to the appliance carcass 12 in an operating state.

The domestic refrigeration appliance apparatus 10 has a suspension unit 20 (see FIGS. 3 and 4). The suspension unit 20 supports the closing unit 18 in such a manner that it is able to oscillate relative to the appliance body 12 in an operating state. In an installed position the suspension unit 20 is arranged below the compartment base 34. In an installed position the suspension unit 20 is arranged substantially between the compartment base 34 and the closing unit 18.

The suspension unit 20 has two suspension elements 22 (see FIGS. 3 and 4). The suspension elements 22 are arranged one behind the other in a depth wise direction 46. The suspension elements 22 are arranged at a distance from one another in the depth wise direction 46. The depth wise direction 46 is aligned substantially perpendicular to the vertical direction 44. The depth wise direction 46 is aligned substantially perpendicular to a rear wall of the appliance carcass 12.

A first of the suspension elements 22 is arranged in a front region of the refrigeration chamber 14 in the depth wise direction 46. A second of the suspension elements 22 is arranged in a rear region of the refrigeration chamber 14 in the depth wise direction 46.

The two suspension elements 22 are fastened to a total of four fixed points on the appliance body 12. In the present exemplary embodiment the two suspension elements 22 are suspended from a total of four fixed points on the appliance body 12. Only one of the suspension elements 22 is described in the following.

The suspension element 22 is fastened to two opposing sides of the appliance body 12. In the present exemplary embodiment the suspension element 22 has a substantially circular configuration when viewed in a cross-sectional plane. The suspension element 22 has a substantially bar-type configuration.

In the present exemplary embodiment the suspension unit 20 has eight connecting elements 24 (see FIGS. 3 and 4). The suspension unit 20 has four connecting elements 24 per closing unit 18. Only one closing unit 18 and four connecting elements 24 are described in the following.

Two connecting elements 24 are arranged in a front region of the closing unit 18 in the depth wise direction 46. The connecting elements 24 arranged in a front region of the closing unit 18 in the depth wise direction 46 are arranged on opposing sides of the closing unit 18 in the horizontal direction 48.

Two connecting elements 24 are arranged in a rear region of the closing unit 18 in the depth wise direction 46. The connecting elements 24 arranged in a rear region of the closing unit 18 in the depth wise direction 46 are arranged on opposing sides of the closing unit 18 in the horizontal direction 48. Only one of the connecting elements 24 is described in the following.

The connecting element 24 connects the suspension element 22 and the closing unit 18 to one another in such a manner that they can move relative to one another. In a mounted state the connecting element 24 is fastened to the closing unit 18 in such a manner that it can be removed without tools.

The connecting element 24 has a latching element 26 (see FIG. 4). The closing unit 18 has a latching recess. The latching element 26 is latched to the closing unit 18 in a mounted state. In a mounted state the latching element 26 partially engages in the latching recess.

The latching element 26 is configured as a single piece with a pivot bearing element 28. The connecting element 24 has the pivot bearing element 28 (see FIG. 4). The pivot bearing element 28 is provided to support the closing unit 18. In an operating state the pivot bearing element 28 supports the closing unit 18 in such a manner that it is able to vibrate.

The connecting element 24 has a hook element 30 (see FIGS. 3 and 4). The hook element 30 is provided for fastening to the suspension element 22. In a mounted state the hook element 30 is suspended from the suspension element 22. The connecting elements 24 arranged next to one another in the horizontal direction 48 are suspended from the suspension element 22 in an inversely phased manner.

The suspension unit 20 has two positioning elements 32 (see FIGS. 3 and 4). The suspension unit 20 has one positioning element 32 per suspension element 22. Only one of the positioning elements 32 is described in the following.

In a mounted state the positioning element 32 is arranged on the suspension element 22. In a mounted state the positioning element 32 is arranged between two hook elements 30 arranged next to one another in the horizontal direction 48. In a mounted state the positioning element 32 partially determines a position of the connecting element 24 on the suspension element 22.

In the present exemplary embodiment the positioning element 32 is configured differently from the suspension element 22. In a mounted state the positioning element 32 partially encloses the suspension element 22.

In the method for operating the domestic refrigeration appliance apparatus 10 the closing unit 18 is supported in such a manner that it is able to oscillate relative to the appliance carcass 12 in an operating state.

To minimize sliding friction the connecting element 24 is made largely of plastic. The suspension element 22 is made largely of plastic.

The following is a summary list of reference numerals and the corresponding structure used in the above description of the invention:

10 Domestic refrigeration appliance apparatus
12 Appliance carcass
14 Refrigeration chamber
16 Storage unit
18 Closing unit
20 Suspension unit
22 Suspension element
24 Connecting element
26 Latching element
28 Pivot bearing element
30 Hook element
32 Positioning element
34 Compartment base
36 Domestic refrigeration appliance
38 Appliance door
40 Further appliance door
42 Door tray
44 Vertical direction
46 Depth wise direction
48 Horizontal direction

The invention claimed is:

1. A domestic refrigeration appliance apparatus, comprising:

at least one appliance body at least partially defining at least one refrigeration chamber;

at least one storage unit disposed within said refrigeration chamber and defining at least one storage chamber for storing food, said storage chamber being open in a direction of an upper face of said storage unit;

a closing unit which at least substantially closes said storage unit in the direction of said upper face in at least one storage state; and at least one suspension unit supporting said closing unit in such a manner that said suspension unit is able to oscillate relative to said appliance body in at least one operating state, said suspension unit having at least one suspension element being fastened to two opposing sides of said appliance body, said suspension unit further having at least one connecting element connecting said suspension element and said closing unit to one another in such a manner that they can move relative to one another.

2. The domestic refrigeration appliance apparatus according to claim 1, wherein said suspension element has an at least substantially bar-shaped configuration.

3. The domestic refrigeration appliance apparatus according to claim 1, wherein said connecting element has at least one latching element, said latching element is latched to said closing unit.

4. The domestic refrigeration appliance apparatus according to claim 1, wherein said connecting element has at least one pivot bearing element, said at least one pivot bearing element supports said closing unit.

5. The domestic refrigeration appliance apparatus according to claim 1, wherein said connecting element has at least one hook element, said hook element is suspended from said suspension element.

6. The domestic refrigeration appliance apparatus according to claim 1, wherein said suspension unit has at least one positioning element, said positioning element at least partially determines a position of said connecting element on said suspension element.

7. The domestic refrigeration appliance apparatus according to claim 6, wherein said positioning element is configured differently from said suspension element and at least partially encloses said suspension element.

8. The domestic refrigeration appliance apparatus according to claim 1, wherein said connecting element is made from plastic.

9. The domestic refrigeration appliance apparatus according to claim 1, further comprising at least one compartment base, below said compartment base said suspension unit is disposed in an installed position.

10. A domestic refrigeration appliance, comprising:

at least one domestic refrigeration appliance apparatus, containing:

at least one appliance body at least partially defining at least one refrigeration chamber;

at least one storage unit disposed within said refrigeration chamber and defining at least one storage chamber for storing food, said storage chamber being open in a direction of an upper face of said storage unit;

a closing unit which at least substantially closes said storage unit in the direction of said upper face in at least one storage state; and at least one suspension unit supporting said closing unit in such a manner that said suspension unit is able to oscillate relative to said appliance body in at least one operating state, said suspension unit having at least one suspension element being fastened to two opposing sides of said appliance body, said suspension unit further having at least one connecting element connecting said suspension element and said closing unit to one another in such a manner that they can move relative to one another.

* * * * *